United States Patent [19]

Corrigan et al.

[11] Patent Number: 4,497,171

[45] Date of Patent: Feb. 5, 1985

[54] COMBUSTION TURBINE ENGINE

[75] Inventors: Charles E. Corrigan, Tempe; Paul R. Dodge, Mesa, both of Ariz.

[73] Assignee: The Garrett Corporation, Los Angeles, Calif.

[21] Appl. No.: 333,502

[22] Filed: Dec. 22, 1981

[51] Int. Cl.[3] ..... F02C 3/00

[52] U.S. Cl. ..... 60/39.75; 415/151; 415/159

[58] Field of Search ..... 60/39.75; 415/148, 150, 415/151, 159

[56] References Cited

U.S. PATENT DOCUMENTS

| | | | |
|---|---|---|---|
| 2,739,782 | 3/1956 | White | 415/150 X |
| 3,318,574 | 5/1967 | Tyler | 415/148 X |
| 3,449,914 | 6/1969 | Brown | 415/150 X |
| 3,567,331 | 3/1971 | Corrigan et al. | 415/148 X |
| 3,905,720 | 9/1975 | Greune et al. | 415/148 |
| 4,291,531 | 9/1981 | Campbell | 60/39.75 X |

FOREIGN PATENT DOCUMENTS

| | | | |
|---|---|---|---|
| 415129 | 9/1911 | France | 415/148 |
| 1142112 | 9/1957 | France | 415/159 |
| 875411 | 8/1961 | United Kingdom | 415/151 |
| 1302180 | 1/1973 | United Kingdom | 415/159 |

*Primary Examiner*—Carlton R. Croyle
*Assistant Examiner*—Donald E. Stout
*Attorney, Agent, or Firm*—Terry L. Miller; Albert J. Miller

[57] ABSTRACT

A combustion turbine engine having an improved variable-area turbine stator assembly defining a flow path for motive fluid. The stator assembly includes a multitude of guide vane members which are movable into and out of the motive fluid flow path to respectively decrease and increase the effective fluid flow area defined thereby.

27 Claims, 12 Drawing Figures

COMBUSTION TURBINE ENGINE

BACKGROUND OF THE INVENTION

This invention relates to turbo machinery apparatus and methods. More particularly, this invention relates to a combustion turbine engine having a turbine section including a stator assembly directing a flow of motive fluid onto a rotatable turbine wheel. The turbine stator assembly uniquely provides a variable flow area for the flow of motive fluid to thereby efficiently accommodate varying engine operating conditions. Thus, this invention relates particularly to a method of operating a combustion turbine engine.

A long-recognized need in the field of turbo machinery has been to provide variable-area turbine stator assemblies for those turbo machines intended to operate under transient or non-steady state conditions. For example, combustion turbine engines designed as aerospace propulsion units may be required to fulfill a variety of mission objectives. Among these mission objectives may be engine operation under take-off, climb, subsonic cruise, supersonic cruise, loiter, and combat power settings at a variety of altitudes and with relatively high engine fuel efficiencies specified for each of the various operational modes. Because the mass air flow rate through the engine varies with the engine operating condition, the turbine stator must define a variable area in order to direct the varying flow of motive fluid onto the turbine wheel to produce best turbine wheel operating efficiency. Engine efficiency is directly influenced by the efficiency of the turbine wheel operation.

A conventional combustion turbine engine having variable stator vanes is known in accordance with U.S. Pat. No. 3,237,918, granted Mar. 1, 1966 to C. E. LeBell, et al., wherein the turbine stator includes stator vanes having a leading edge portion extending radially between a pair of concentric annular walls. The annular walls are generally cylindrical in the vicinity of the stator vanes and bound an annular flow path for the motive fluid. The stator vanes each include a movable trailing edge portion and a flexible midsection connecting the leading and trailing edge portions. An actuator mechanism extending into each stator vane connects with the movable trailing edge portions. By moving the trailing edge portions relative to the leading edge portions, the flow area through the turbine stator is variable.

A combustion turbine engine having a turbine stator assembly according to the LeBell, et al., invention has a number of recognized deficiencies. Among these deficiencies is the fact that each stator vane is a complex assembly of component parts. Consequently, the turbine stator assembly is complex and expensive to manufacture. Further, the flexible mid-section of each stator vane must flex within the hot motive gas flow each time the area of the turbine stator assembly is changed. As a result, the stator vanes may be prone to failure and may require frequent maintenance. Moreover, because the walls which bound the flow path are cylindrical in the vicinity of the stator vanes, the walls do not define an optimally-shaped flow path for the motive fluid upstream of the turbine wheel. Thus, the efficiency of the turbine wheel and of the engine may be decreased because the motive fluid is not directed onto the turbine wheel to produce optimum effect. Still further, because there exists a considerable fluid pressure difference between the suction or convex side of the stator vanes and the pressure or concave side of the vanes, motive fluid leaks between the ends of the stator vanes and the walls which bound the flow path. Experience has shown that this leakage alone is responsible for a major part of the efficiency loss of conventional variable-area stator assemblies. Consequently, it has been proposed to provide sealing members at the ends of the stator vanes which would sealingly and movably engage the walls of the flow path. However, the use of such sealing members requires that the walls of the flow path be generally cylindrical in the vicinity of the sealing members, so that a non-optimum flow path shape results and limits engine efficiency.

In light of the many recognized deficiencies of conventional variable-area turbine stators the results of recent studies are all the more perplexing. These studies of future aerospace applications for combustion turbine engines indicate a need for an engine having a variable-area turbine stator capable of about a 30 percent area variation. This 30 percent area variation is significantly greater than that achieved by conventional variable-area stators. It is expected that an attempt to build a conventional variable-area turbine stator capable of a 30 percent area variation would result in an exacerbation of the recognized deficiencies of the conventional stator and an unsatisfactory engine performance.

SUMMARY OF THE INVENTION

In view of the recognized deficiencies of conventional turbo machinery having variable-area turbine stators, it is an object for this invention to provide a turbo machine with a variable-area turbine stator substantially eliminating the leakage of motive fluid at the ends of the stator vanes.

Another object for this invention is to provide a turbo machine with a turbine stator providing a near-optimum shape for the motive fluid flow path.

Another object for this invention is to provide a turbo machine with a variable-area turbine stator capable of about a 30 percent area variation.

Still another object for this invention is to provide a turbo machine with a variable-area turbine stator wherein the actuating mechanism for the stator assembly is comparatively simple and inexpensive to manufacture.

Yet another object for this invention is to provide a turbo machine having a variable-area turbine stator including a multitude of circumferentially spaced stator vanes disposed in the motive fluid flow path upstream of a turbine wheel and a multitude of members movably interdigitating radially with the stator vanes to vary the fluid flow area defined by the stator assembly.

Still another object for this invention is to provide a method for varying the fluid flow area defined by a stator assembly of a turbo machine.

Yet another object for this invention is to provide a method of operating a turbo machine.

An advantage of a combustion turbine engine according to this invention is that the movable members are movable out of the fluid flow path. As a result, the surface area at the stator assembly which is exposed to the flowing motive fluid is reduced when the members are removed from the flow path. Therefore, when the members are removed from the flow path, the surface area which must be cooled is reduced. Further, the actuating mechanism for the movable members is located in a relatively cool area removed from the hot motive fluid. Still further, during high-power, high mass flow rate operation of an engine according to this invention, during which the movable members are removed from the flow path, the engine benefits from the advantages of a highly efficient fixed-geometry turbine stator. That is, during high-power operation the engine behaves as though it were equipped with a fixed-geometry turbine stator designed for high-power operation rather than with a conventional variable-area stator with all of the concomitant comprises in design and reductions in engine efficiency which such a stator has in the past implied. On the other hand, during intermediate-power operation, during which the movable members are moved into the fluid flow path, the engine enjoys an efficiency advantage over an otherwise comparable engine equipped with a conventional variable-area stator.

A further advantageous aspect of a combustion turbine engine with a variable-area stator according to this invention is that the angulation imparted to the motive fluid with respect to the axis of rotation of the turbine wheel does not change significantly with variations in the stator assembly area. Conventional variable-area stator assemblies increase the angulation of the fluid flow as the area of the stator assembly is reduced. This increase in angulation may be in contradiction to what is desired in view of the fluid mass flow rate and turbine speed of the engine during intermediate-power operation.

In summary, this invention provides a combustion turbine engine with a variable-area turbine stator assembly which provides an increase in engine efficiency throughout a variety of engine operating conditions when compared with conventional combustion turbine engines.

Other objects and advantages of the invention will appear in light of the following detailed description of a preferred embodiment of the invention.

DETAILED DESCRIPTION OF THE PREFERRED EMBODIMENTS

Figure 1:
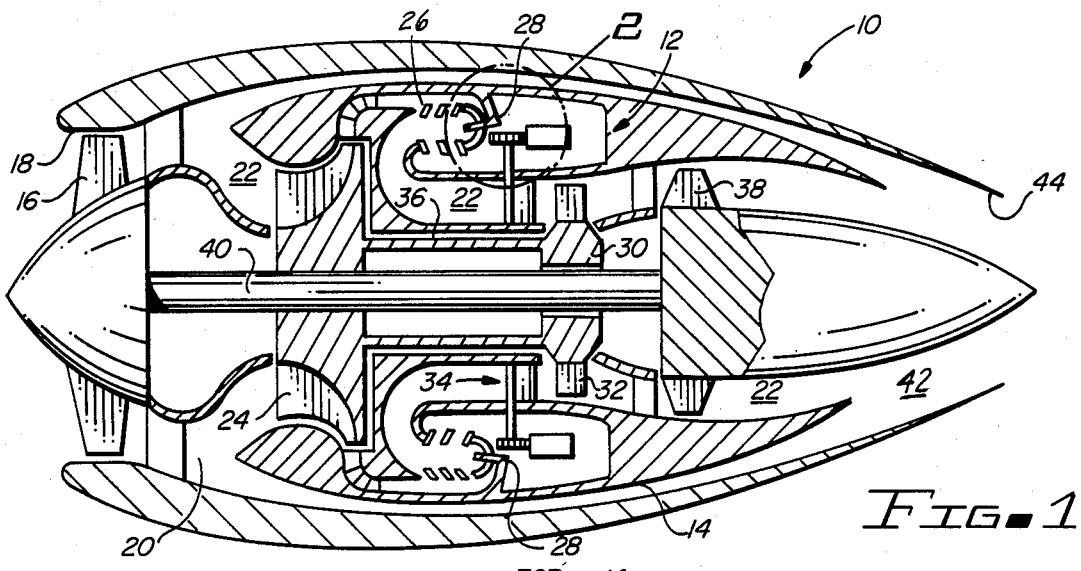
FIG. 1 is a diagrammatic axial cross-sectional view of a combustion turbine engine embodying the invention.

FIG. 1 shows a combustion turbine engine 10. Engine 10 is of the turbo-fan type including a core engine, generally referenced 12, and an annular outer air passage 14. A first stage fan 16 inducts ambient air through an inlet 18, compresses the ambient air, and delivers the compressed air to a bifurcated flow path 20. The flow path 20 communicates both with the air passage 14 and with a second flow path 22 extending through the core engine 12.

The core engine 12 includes a second stage centrifugal compressor 24 and an annular combustor 26. The compressor 24 and combustor 26 in combination comprise a motive gas generator for the core engine 12. The combustor 26 receives compressed air from the centrifugal compressor 24 and fuel via conduits 28 to maintain combustion producing a supply of high-temperature, high-pressure motive gas. Flow path 22 continues annularly through the core engine 12 from the combustor 26 to communicate the motive gas to a turbine wheel 30. The turbine wheel 30 includes a multitude of radially outwardly extending turbine blades 32 (only two of which are visible in FIG. 1) disposed in the flow path 22. Upstream of the turbine wheel 30 a stator assembly 34 is disposed in the flow path 22. The stator assembly 34 converts a portion of the pressure and temperature energy of the flowing motive gas into kinetic energy to rotatably drive the turbine wheel 30. A hollow shaft 36 drivingly connects the turbine wheel 30 to the centrifugal compressor 24.

From the turbine wheel 30, the motive gas flows in flow path 22 to a second turbine wheel 38 which is drivingly connected by a shaft 40 with the fan 16. Finally, the motive gas flows via flow path 22 to a confluent flow path 42 which also receives compressed air via the air passage 14. The confluent flow path 42 leads to an exit nozzle 44.

Having observed the general structural features of the engine 10, attention may now be given to the stator assembly 34. Viewing FIGS. 2–6, it will be seen that the stator assembly 34 includes a first multitude of radially span-wise extending and aerodynamically shaped stator vanes 46. The stator vanes 46 are annularly arrayed and are substantially immovably secured to concentrically disposed radially inner and radially outer circumferentially extending casing walls 48 and 50, respectively, which annularly bound the flow path 22. Viewing FIG. 2, it will be seen that the wall 48 conically tapers axially so that the flow path 22 converges toward the turbine wheel 22. Each of the stator vanes 46 is airfoil shaped in cross section, viewing FIG. 4, and defines a leading edge 52 and trailing edge 54 with respect to motive gas flow. The trailing edges 54 cooperate to define a substantially radially extending transverse plane P. Further, the stator vanes 46 are circumferentially spaced apart so that a throat T is defined between each adjacent pair of the trailing edges 54, viewing FIG. 4. The stator vanes 46 are cambered and positioned within the flow path 22 so that motive gas flowing from the stator assembly 46 to the turbine wheel 30 has a determined angularity with respect to the rotational axis of the turbine wheel, which is indicated by angle $\theta$, viewing FIG. 4. Of course those skilled in the art to which this invention pertains will understand that the angle $\theta$ may vary radially along the stator vanes so that any particular angle $\theta$ is illustrative only and may be dependent upon the radial position along the stator vanes at which the angle is determined. The radially inner and radially outer ends, 56 and 58 respectively, of each stator vane sealingly engage the respective casing wall 48 and 50 so that motive fluid cannot leak at the interface.

Movably interdigitating with the stator vanes 46 is a second multitude of radially span-wise extending guide vanes 60. Each of the guide vanes 60 is movably received by a respective one of a corresponding multitude of recesses 62 which are defined by the wall 50. Each guide vane 60 extends radially inwardly from the wall 50 to terminate in a radially inner end 64 which is engageable with the wall 48. The inner ends 64 taper axially to substantially match the wall 48 so that leakage of motive fluid between the end 64 and wall 48 is substantially prevented.

Figure 2:
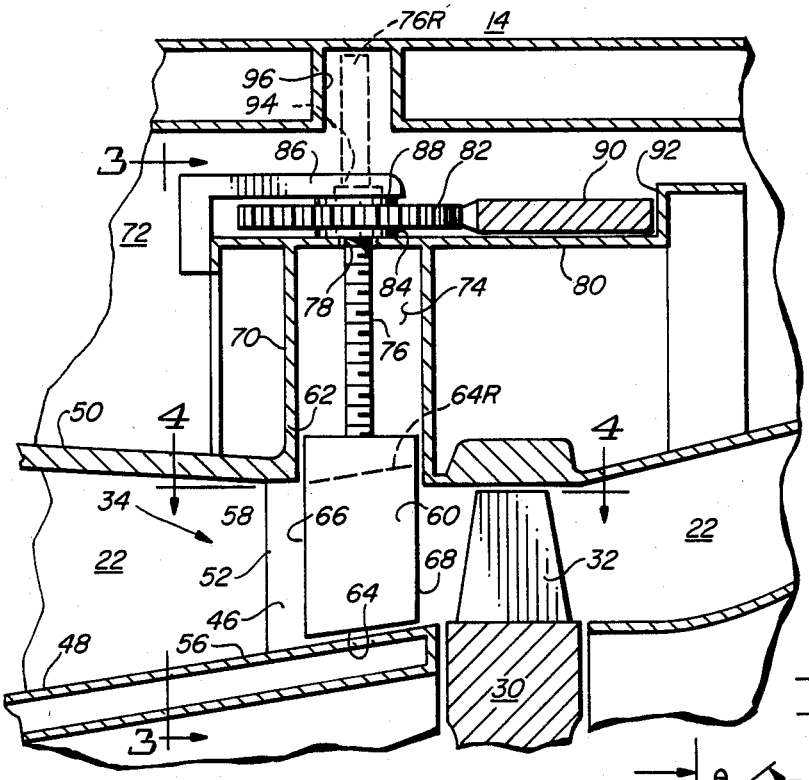
FIG. 2 is an enlarged view of an encircled portion of FIG. 1.
Figure 4:
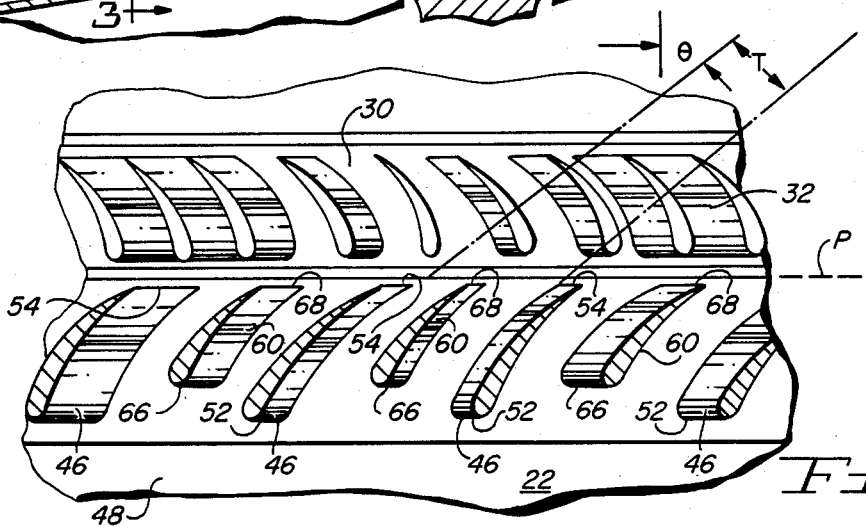
FIG. 4 is a fragmentary view, partly in cross section, taken along lines 4—4 of FIGS. 2 and 3.
Figure 3:
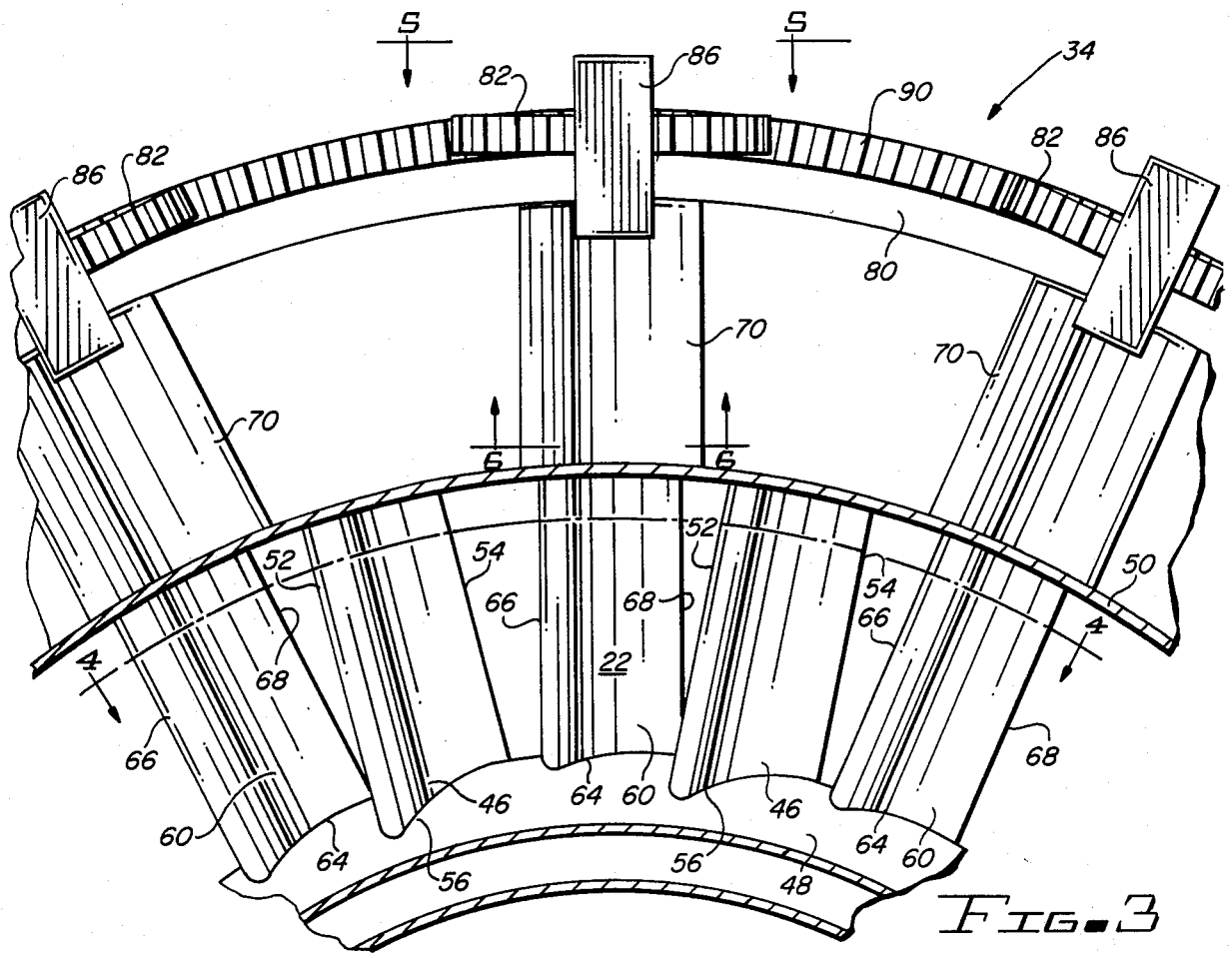
FIG. 3 is a fragmentary view, partly in cross section, taken along the line 3—3 of FIG. 2.
Figure 5:
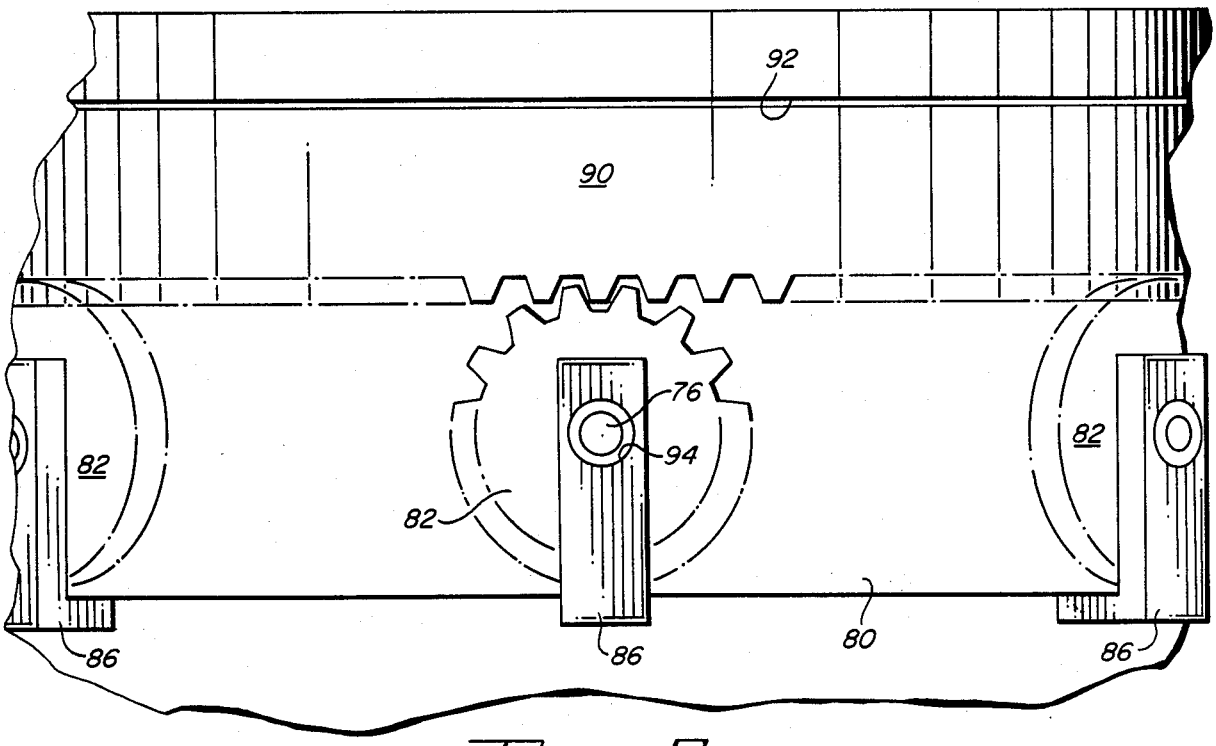
FIG. 5 is a fragmentary view taken along line 5—5 of FIG. 3.
Figure 6:
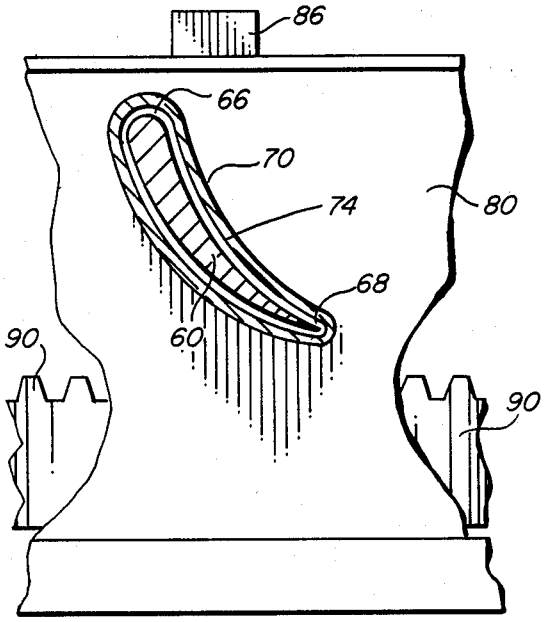
FIG. 6 is a fragmentary view, partly in cross section, taken along line 6—6 of FIG. 3.

Each of the guide vanes 60 is aerodynamically shaped and has an airfoil shape in cross section. With respect to the flow of motive fluid, the guide vanes 60 each define a leading edge 66 and a trailing edge 68. FIGS. 2 and 4 show that the leading edges 66 of the guide vanes 60 are spaced downstream from the leading edges 52 of the stator vanes 46. However, the trailing edges 68 are substantially in the same radially extending transverse plane P as the trailing edges 54 of the stator vanes 46. The guide vanes 60 are located circumferentially so as to bisect the throats T.

In order to move the guide vanes 60 into and out of the flow path 22, a multitude of bosses 70 extend radially outwardly from the wall 50. The bosses 70 extend into an annular chamber 72 which communicates with the flow path 22 upstream of the combustors 26. Thus, the chamber 72 receives relatively cool compressed air therein. Further, because of the pressure drop inherent in the combustors 26, the chamber 72 receives compressed air having a higher pressure level than that of the motive gas in the flow path 22 at the stator vanes 46. Each one of the bosses 70 circumscribes a respective one of the recesses 62 and defines a radially extending cavity 74. The cavities 74 are shaped to correspond to and slidably receive the guide vanes 60, viewing FIG. 6. Each of the guide vanes 60 includes a stem 76 extending radially outwardly through an aperture 78 defined by a circumferentially extending annular ring 80. The ring 80 secures to the outer ends of the bosses 70. A spur gear 82 threadably engages each one of the stems 76 and rotatably engages the ring 80 via a thrust washer 84. Similarly, each of the spur gears 82 rotatably engages an L-shaped retainer 86 via a thrust washer 88. The retainer 86 secures to the ring 80. Consequently, the spur gears 82 are restrained from radial movement. An annular ring gear 90 is rotatably carried on the ring 80 between a shoulder 92 and the spur gears 82. The ring gear 90 drivingly engages each one of the spur gears 82. A servo motor (not shown) drivingly couples with the ring gear 90 to move the latter circumferentially.

During operation of the combustion turbine engine 10, the ring gear 90 is rotatable by the servo motor (not shown) to rotatably drive the spur gears 82. Because a radially outer portion of each guide vane 60 is received in the respective recess 62 and cavity 74, the guide vanes are not rotatable about a radially extending axis defined by the respective stems 76. Further, because the spur gears 82 are restrained from radial movement, rotation of the spur gears in either direction moves the stems 76 radially. Consequently, the guide vanes 60 are radially movable between the extended positions shown in solid lines in FIGS. 1–6, and a retracted position shown in dashed lines in FIG. 2. In the restrained position, the radially inner end 64 of the guide vanes 60 are received into the recesses 62, as is illustrated in FIG. 2 at 64R. Similarly, the stems 76 extend radially outwardly through apertures 94 defined by the retainers 86, as is illustrated at 76R, viewing FIG. 2. The engine defines receptacles 96 for receiving the radially outer ends of the stems 76. The guide vanes 60 are also movable inwardly from the retracted position and may be maintained at any selected intermediate position.

As the guide vanes 60 are moved inwardly or outwardly, the area defined for fluid flow at the stator assembly 34 by the cooperation of the walls 48 and 50 with the stator and guide vanes 56 and 60 respectively decreases or increases, by as much as 30 percent or more. However, as FIG. 4 illustrates, the guide vanes 60 are aerodynamically shaped similarly to the stator vanes 46 to cooperate with the stator vanes so that the angulation $\theta$ of the fluid flow does not change significantly as the guide vanes move radially into or out of the flow path 22. Moreover, the velocity of the motive gas flowing to turbine wheel 30 may remain substantially constant or vary over a relatively small range as the mass flow rate of air through the flow path 22 varies.

Figure 7:
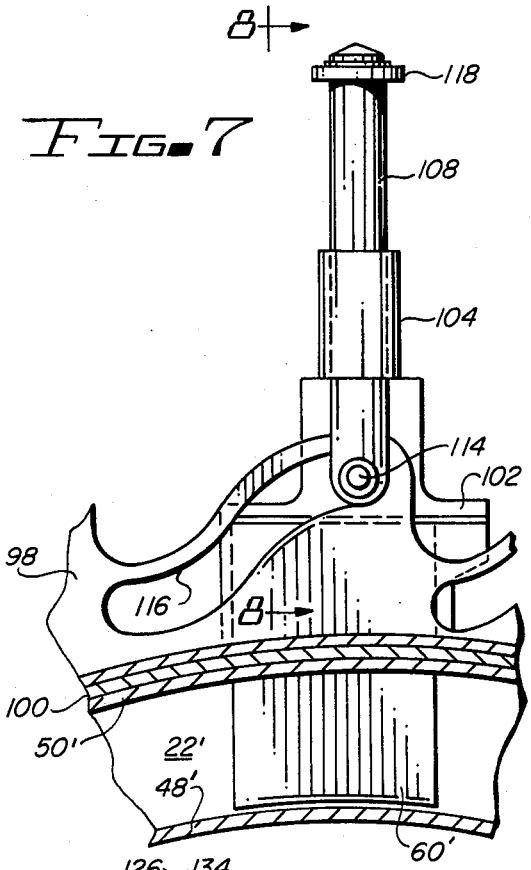
FIG. 7 is a fragmentary view, partly in cross section of an alternative embodiment of the invention.
Figure 8:
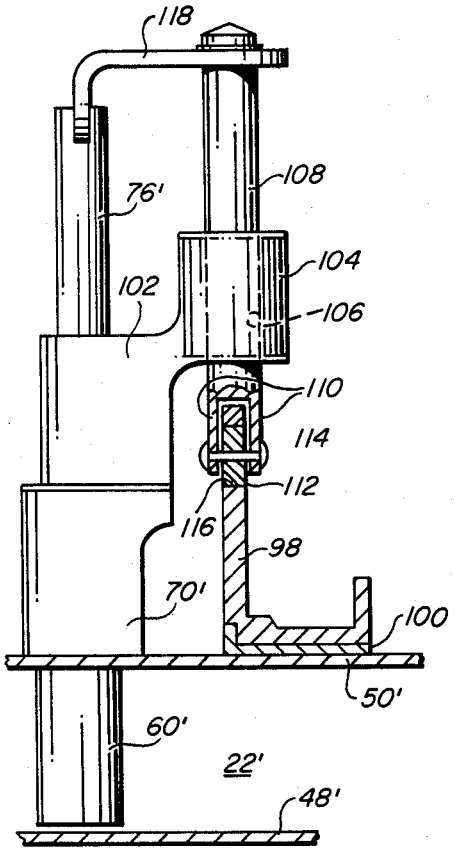
FIG. 8 is a fragmentary view, partly in cross section, taken along line 8—8 of FIG. 7.

FIGS. 7 and 8 illustrate an alternative embodiment of the invention which differs from the embodiment illustrated in FIGS. 1–6 principally in the mechanism employed to radially move the guide vanes 60. Consequently, features which are analogous in structure or function to those illustrated in FIGS. 1–6 are referenced with the same numeral previously used with a prime added.

The combustion turbine engine illustrated in FIGS. 7 and 8, includes a circumferentially extending annular cam ring 98 which is rotatably carried upon a bearing ring 100. The radially outer casing wall 50' carries the bearing ring 100. A servo motor (not shown) drivingly couples with the cam ring 98 to move the latter circumferentially. Each one of the bosses 70' carries a cap piece 102. The stem 76' of each guide vane 60' extends radially outwardly through an aperture (not visible in the Figures) which is defined by the respective cap piece 102. Each one of the cap pieces 102 includes an axially extending appendage 104 defining a radially extending bore 106. A cam follower 108 is movably received in the bore 106. The cam follower 108 defines a pair of legs 110 straddling the cam ring 98. A roller member 112 is carried between the legs 110 by a pin 114 extending between the latter. The roller member 112 is received in a radially and circumferentially extending cam slot 116 defined by the cam ring 98. A link 118 drivingly connects the cam follower 108 with the stem 76'.

When the cam ring 98 is moved circumferentially by the servo motor (not shown), the cam follower 108 is driven radially inwardly or radially outwardly to move the stem 76' and guide vane 60' via the link 118.

Figure 9:
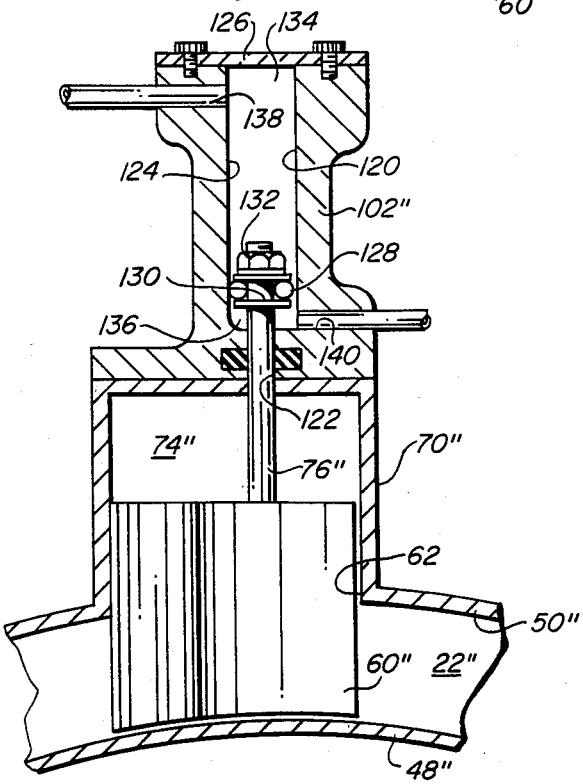
FIG. 9 is a fragmentary view, partly in cross section, of another alternative embodiment of the invention.

FIG. 9 illustrates yet another embodiment of the invention which, similarly to the embodiment of FIGS. 7 and 8, differs from the first preferred embodiment principally in the mechanism moving the guide vanes.

Features illustrated in FIG. 9 which are analogous in structure or function to those of FIGS. 1–8 are referenced with like reference numerals having a double prime added.

The engine illustrated in FIG. 9 includes a multitude of radially extending bosses 70'' defining respective cavities 74'' each movably receiving a guide vane 60''.

A cap piece 102'' is carried by each boss 70''. The cap piece 102'' defines a radially extending stepped bore 120 having a small diameter portion 122 and a large diameter portion 124. An end wall 126 closes the radially outer end of the bore 120. The stem 76'' sealingly and movably passes through the small diameter bore portion 122. An annular piston member 128 is carried upon the stem 76'' between a shoulder 130 defined on the latter and a nut 132 threadably engaging the stem. The piston member 128 sealingly and movably engages the bore portion 124. The stem 76'', end wall 126, and piston member 128 cooperate to substantially define a pair of variable-volume chambers 134 and 136. A pair of inlet/-outlet ports 138, 140 selectively communicate the chamber 134 and 136 alternatively to sources of high pressure and low pressure fluid (not shown).

When the chambers 134 and 136 communicate respectively with the high pressure and low pressure fluid sources, the piston member 128, stem 76'', and guide vane 60'' are maintained in the position illustrated in FIG. 9. Of course, it will be understood that when the communication of the high and low pressure fluid sources with chambers 134 and 136 is reversed, the piston member 128, stem 76'', and guide vane 60'' are movable radially outwardly to a retracted position wherein the guide vane is received in cavity 74''.

Figure 10:
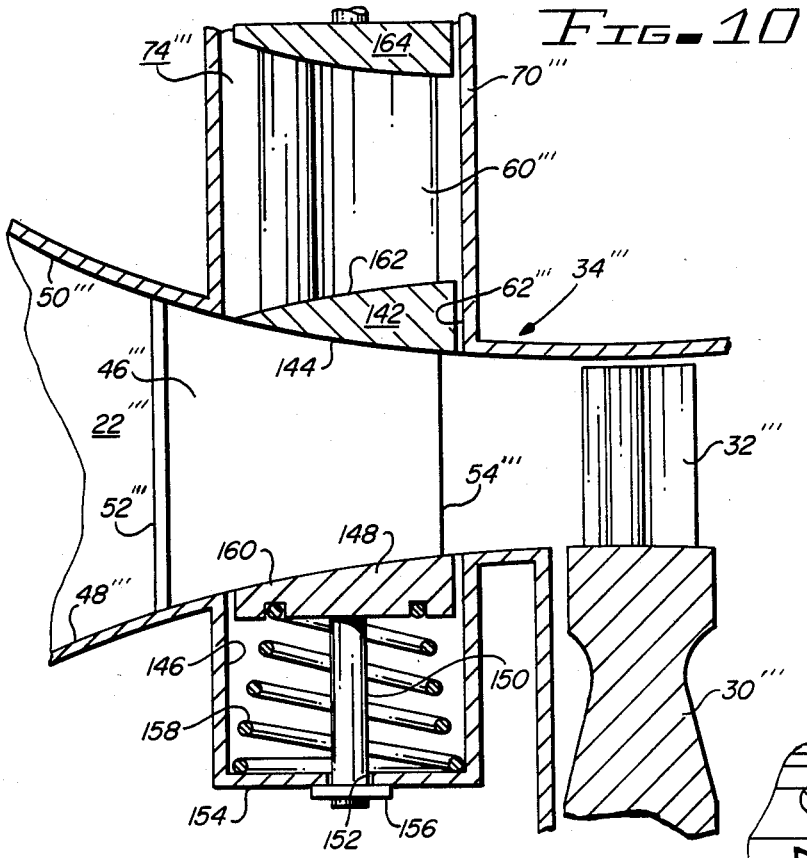
FIG. 10 is a diagrammatic fragmentary axial cross-sectional view illustrating yet another alternative embodiment of the invention.
Figure 11:
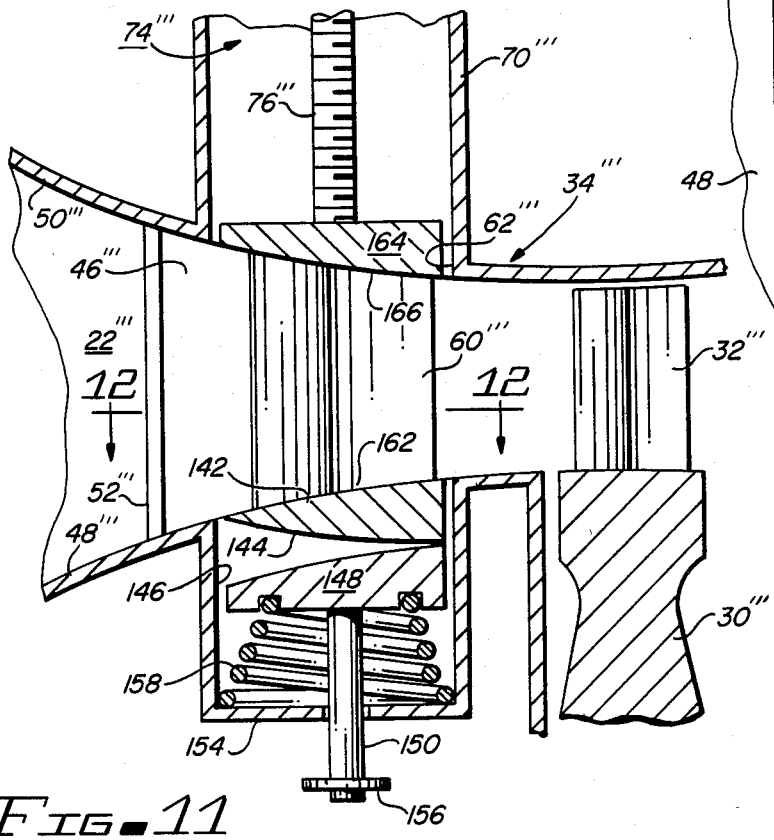
FIG. 11 is a diagrammatic view similar to FIG. 10 illustrating the engine in an alternative operational configuration.
Figure 12:
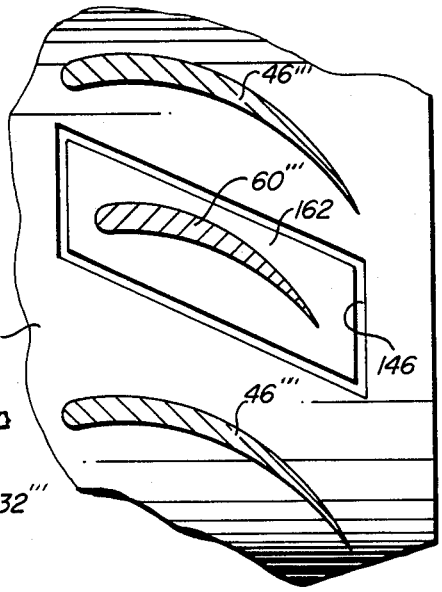
FIG. 12 is a fragmentary view, partly in cross section, taken along line 12—12 of FIG. 11.

FIGS. 10–12 diagrammatically illustrate yet another embodiment of the invention wherein features which are analogous in structure or function to those of FIGS. 1–9 are references with like numerals having a triple prime added.

FIG. 10 illustrates an engine having a stator assembly 34''' including radially inner and radially outer casing walls 48''' and 50''', respectively, which curvilinearly taper axially. By way of example only, the walls 48''' and 50''' may define segments of a parabola. Thus, the flow path 22''' which is bounded by the walls 48''' and 50''' may define a nearly optimum shape for the flow of motive fluid toward the turbine wheel 30'''. The engine includes an annularly arrayed multitude of stator vanes 46''' and an annularly arrayed multitude of guide vanes 60''' which are interdigitatable with the stator vanes 46'''. The guide vanes 46''' are illustrated in their retracted position. Viewing FIG. 10, it will be seen that the guide vanes 46''' each carry a shoe member 142. The shoe members 142 each define a radially inner surface 144 which tapers curvilinearly to substantially match the wall 50'''. When the guide vanes 46''' are in their retracted position, the shoe members 142 are retracted into the recesses 62''' and cavities 74''' to substantially close the recesses 62''' with the surface 144 substantially flush with the wall 50'''.

Further, the inner wall 48''' defines a multitude of radially extending recesses 146, each of which is congruent with a respective one of the recesses 62'''. A plug member 148 is movably received in each of the recesses 146. Each of the plug members 148 includes a stem 150 extending radially inwardly through an aperture 152 defined by the end wall 154 of each recess 146. The stem 150 carries a retainer 156 engageable with the radially inner surface of the wall 154. A conical coil compression spring 158 extends between the end wall 154 and the plug member 148 to yieldably bias the latter radially outwardly to a flush position. Each plug member 148 defines a radially outer surface 160 which curvilinearly tapers axially to substantially match the wall 48'''. In the flush position of the plugs 148, the plug members substantially close the recesses 146 and the surfaces 160 are substantially flush with the wall 48'''.

FIG. 11 illustrates that when the guide vanes 60''' are moved to their radially inward position, the shoe members 142 are received into the recesses 146. Each shoe member 142 engages a respective plug member 148 to force the latter radially inwardly into the recess 146. Each shoe member 142 defines a radially outer surface 162 tapering curvilinearly to substantially match the wall 48'''. Thus, when the guide vanes 60''' are in the position illustrated in FIG. 11, the shoe members substantially close the recesses 146 with the surfaces 162 substantially flush with the wall 48'''.

FIG. 11 also illustrates that each guide vane 60''' includes a base member 164 movably received in the recess 62'''. Each base member 164 defines a surface 166 tapering curvilinearly to substantially match the wall 50'''. When the guide vanes 60''' are moved to the extended position illustrated in FIG. 11, the base members substantially close the recesses 62''' with the surfaces 166 substantially flush with the wall 50'''.

In light of the above, it is apparent that this invention provides turbo machine methods as well as apparatus. While the invention has been described with reference to preferred embodiments thereof, no limitation upon the invention should be implied because of such reference. The invention is intended to be limited only by the spirit and scope of the appended claims.

We claim:

1. A combustion turbine engine comprising a gas generator means for producing a supply of motive gas, a flow path for communicating said motive gas to a turbine section of said engine, said turbine section including a turbine wheel rotatable about an axis, and means for selectively varying the area of said flow path which is available for the flow of said motive gas, said area varying means including a multitude of spaced apart stator vanes disposed in said flow path upstream of said turbine wheel, and a multitude of members of determined transverse cross sectional shape within said flow path movably interdigitating with said stator vanes, said members being movable into and out of said flow path, said area varying means further defining a respective multitude of cavities of said determined transverse cross sectional shape matching closely with said multitude of members, said members being receivable into said cavities when moved out of said flow path during operation of said engine, and mechanical actuator means for moving said multitude of members between respective positions within said flow path and within said multitude of cavities during engine operation.

2. The invention of claim 1 wherein said multitude of members includes a guide vane having an airfoil shape in cross section.

3. The invention of claim 1 wherein said members are movable substantially radially with respect to said axis.

4. The invention of claim 2 wherein said turbine wheel is of the axial flow type, said engine including a housing having a radially inner casing portion and a radially outer casing portion concentrically arranged to annularly bound said flow path, one of said casing portions defining a multitude of apertures opening to said flow path upstream of said turbine wheel and communicating respectively with said multitude of cavities, each one of said multitude of apertures slidably receiving a respective one of said multitude of members.

5. The invention of claim 1 wherein said multitude of stator vanes are annularly arranged, each of said members comprising a guide vane having an air foil shape in transverse cross section, said stator vanes each having a leading edge, and said guide vanes being spaced downstream of said leading edge.

6. The invention of claim 4 wherein said stator vanes extend radially span-wise between said inner and outer casing portions, each one of said members comprising a guide vane having an airfoil shape in cross section, said members being span-wise slidably receivable into said apertures.

7. The invention of claim 6 wherein said guide vanes are movable span-wise into and out of said flow path.

8. The invention of claim 1 further including actuator means for moving said multitude of members into and out of said flow path.

9. The invention of claim 8 wherein said actuator means includes an annular gear ring, said gear ring being rotatable to move said members into and out of said flow path, each one of said members including a stem extending radially outwardly therefrom, an annular gear member threadably and rotatably engaging each one of said stems, said gear members being restrained from radial movement, said gear ring drivingly engaging each one of said gear members.

10. The invention of claim 8 wherein said actuator means includes an annular cam ring, said cam ring being rotatable to move said members into and out of said flow path, each one of said members including a stem extending radially outwardly therefrom, a cam follower drivingly coupling with each one of said stems and movingly engaging a respective cam surface defined by said cam ring.

11. The invention of claim 8 wherein said actuator means includes a multitude of radially extending cylinder bores defined by a housing of said engine, each one of said members including a stem sealingly extending through an annular end wall of a respective one of said cylinder bores, each of said stems sealingly cooperating with said respective cylinder bore to substantially define a pair of variable-volume chambers, each of said pair of variable-volume chambers selectively communicating with a source of pressure fluid.

12. The invention of claim 1 wherein adjacent pair of said stator vanes cooperate to define a throat for the flow of said motive gas, each of said members bisecting said throat.

13. A combustion turbine engine comprising:

compressor means for inducting and compressing ambient air;

combustor means for receiving said compressed air along with a supply of fuel from a source thereof to maintain combustion producing a supply of motive fluid;

flow path means for communicating said supply of motive fluid to a rotatable turbine wheel, said flow path means including stator means for directing said flow of motive fluid onto said turbine wheel;

said stator means including coannular radially inner and radially outer housing portions radially spaced apart to bound said flow path for axial flow of said motive fluid;

a first multitude of circumferentially spaced radially span-wise extending stator vanes immovably securing to said housing portions, one of said housing portions defining a plurality of circumferentially spaced recesses opening to said flow path;

said plurality of recesses movably receiving a second multitude of circumferentially spaced radially span-wise extending guide vanes having a determined aerodynamic shape within said fluid flow path and moving into and out of said fluid flow path;

said stator means further including a multitude of radially extending cavities communicating respectively with said multitude of recesses, said multitude of cavities substantially matching said aerodynamic shape of said multitude of guide vanes and slidably receiving the latter when moving out of said fluid flow path; and mechanical actuator means for moving and multitude of guide vanes between a first position wherein at least a portion of each one of said multitude of guide vanes is disposed within said flow path, and a second position wherein each of said multitude of guide vanes is stowed within a respective one of said multitude of cavities and substantially removed from said flow path during operation of said engine.

14. Combustion turbine engine apparatus comprising annular wall means for bounding a fluid flow path wherein motive fluid flows axially during operation of said engine apparatus, a circumferentially disposed and spaced-apart multitude of radially extending guide vane means in a first position thereof extending radially from said wall means a determined distance into said fluid flow path, each guide vane of said multitude of guide vane means being substantially airfoil shaped in transverse cross section, said wall means defining a respective multitude of radially extending storage cavities substantially matching in cross section with and slidably receiving individually said multitude of guide vane means for radial relative movement therebetween, each cavity of said multitude of cavities opening to said fluid flow path in a respective recess on said wall means, mechanical actuator means for selectively radially moving said guide vane means during operation of said engine apparatus relative to said fluid flow path and said multitude of cavities to a second position wherein said guide vane means extend into said fluid flow path a certain distance differing from said determined distance, whereby said multitude of guide vane means are selectively movable during engine operation between selected positions of extension into said fluid flow path and selected positions of withdrawal from said fluid flow path and storage in said multitude of storage cavities by operation of said mechanical actuator means.

15. The invention of claim 14 wherein said multitude of guide vane means are slidably movable radially to a third position substantially entirely within said respective multitude of cavities wherein said guide vane means extend substantially not at all into said fluid flow path.

16. The invention of claim 14 wherein said apparatus comprises another annular wall means for bounding said fluid flow path in cooperation with said annular wall means, one of said annular wall means and said another annular wall means axially tapering, each guide vane of said multitude of guide vanes defining a distal end confronting said one annular wall, said guide vane distal end substantially matching said axial taper of said one annular wall means.

17. Combustion turbine engine apparatus comprising annular wall means for bounding a fluid flow path wherein motive fluid flows axially during operation of said engine apparatus, a circumferentially disposed and spaced-apart multitude of radially extending guide vane means in a first position thereof extending radially from said wall means a determined distance into said fluid flow path, each guide vane of said multitude of guide vane means being substantially airfoil shaped in transverse cross section, said wall means defining a respective multitude of radially extending cavities substantially matching in cross section with and slideably receiving said multitude of guide vane means for radial relative movement therebetween, each cavity of said multitude of cavities opening to said fluid flow path in a respective recess on said wall means, actuator means for selectively radially moving said guide vane means relative to said fluid flow path and said multitude of cavities to a second position wherein said guide vane means extend into said fluid flow path a certain distance differing from said determined distance, said apparatus further comprising another annular wall means radially spaced from said annular wall means and cooperating with the latter to bound said fluid flow path, at least one of said annular wall means and said another annular wall means axially tapering, each guide vane of said multitude of guide vane means including a shoe member at the radial end thereof adjacent said fluid flow path, said shoe member defining a radially disposed surface which extends both axially and circumferentially to substantially match said one of said annular wall means.

18. The invention of claim 17 wherein the other of said annular wall means and said another annular wall means defines openings to a multitude of radially extending sockets congruent with said multitude of guide vane means, each socket of said multitude of sockets receiving a respective one of a respective multitude of plug members radially movably disposed therein, said multitude of plug members being resiliently biased to a first position wherein radially disposed surfaces thereof confronting said flow path are substantially flush with said other annular wall means, said multitude of shoe members being radially engageable with said multitude of plug members and matching said multitude of sockets to move said multitude of plug members to a second position spaced from said fluid flow path within said sockets.

19. The invention of claim 18 wherein each shoe member of said multitude of shoe members also defines another radially disposed surface facing oppositely from said first recited radially disposed surface, said another radially disposed surface extending axially and circumferentially to substantially match and be flush with said another annular wall means upon said multitude of shoe members being moved into said multitude of sockets.

20. Combustion turbine engine apparatus comprising a first and a second axially extending annular wall, said first and second wall being coannular and radially spaced apart to bound therebetween an axially extending annular fluid flow path, one of said first and second wall further defining a multitude of circumferentially arrayed and spaced apart radially extending cavities each having a like determined internal transverse cross sectional shape, said multitude of cavities opening to said fluid flow path in respective circumferentially spaced apart recesses and including a substantially continuous radially extending internal surface defining said internal cross sectional shape, a respective multitude of circumferentially arrayed and spaced apart guide vanes each having a portion thereof of said determined transverse cross sectional shape and slidably received individually in respective ones of said multitude of cavities for relative radial movement into and out of said fluid flow path, and mechanical actuator means for selectively moving said multitude of guide vanes into and out of said fluid flow path during operation of said engine.

21. The invention of claim 20 further including a multitude of circumferentially arrayed and spaced apart stator vanes of aerodynamic configuration extending radially between said first and second wall within said fluid flow path, said multitude of cavities being so disposed with respect to said multitude of stator vanes that said guide vanes interdigitate therewith when moving into said fluid flow path.

22. The invention of claim 20 wherein said portion of each of said multitude of guide vanes defines a radially disposed surface extending axially, said radially disposed surface matching a contour of said one wall within the axial extension of said portion.

23. Combustion turbine engine apparatus comprising a first and a second axially extending annular wall, said first and second wall being coannular and radially spaced apart to bound therebetween an axially extending annular fluid flow path, one of said first and second wall further defining a multitude of circumferentially arrayed and spaced apart radially extending cavities each having a like determined internal transverse cross sectional shape, said multitude of cavities opening to said fluid flow path in respective circumferentially spaced apart recesses and including a substantially continuous radially extending internal surface defining said internal cross sectional shape, a respective multitude of circumferentially arrayed and spaced apart guide vanes each having a portion thereof of said determined transverse cross sectional shape and slidably received individually in respective ones of said multitude of cavities for relative radial movement into and out of said fluid flow path, and mechanical actuator means for selectively moving said multitude of guide vanes into and out of said fluid flow path during operation of said engine, wherein said portion of each of said multitude of guide vanes defines a radially disposed surface extending axially, said radially disposed surface matching a contour of said one wall within the axial extension of said portion, wherein each said portion comprises a shoe member disposed adjacent said fluid flow path when the respective guide vane is fully withdrawn therefrom and said radially disposed surface aligning with said one wall and bounding said fluid flow path upon full withdrawal of said respective guide vane from said fluid flow path.

24. The invention of claim 23 wherein the other of said first and second wall defines a respective multitude of circumferentially arrayed and spaced apart sockets extending radially away from said fluid flow path, each one of said multitude sockets being radially congruent with a respective one of said multitude of guide vanes to receive the respective shoe member upon movement of said guide vanes fully into said fluid flow path.

25. The invention of claim 24 wherein each shoe member further defines another radially disposed surface extending axially, said another radially disposed surface matching a contour of said other wall within the axial extension of said shoe member, said another radially disposed surface aligning with said other wall and bounding said fluid flow path upon movement of said multitude of guide vanes fully into said fluid flow path to dispose said multitude of shoe members in said multitude of sockets.

26. The invention of claim 24 wherein said apparatus further comprises a respective multitude of plug members movably received within said multitude of sockets, each one of said multitude of plug members defining a respective radially disposed surface extending axially, said respective radially disposed surface matching a contour of said other wall within the axial extension of said respective plug member, said plug members being movable between a first position wherein said respective radially disposed surface aligns with said other wall to bound said fluid flow path and a second position wherein said plug members in response to full insertion of said guide vanes into said fluid flow path are spaced from the latter within said sockets.

27. Combustion turbine engine apparatus comprising a first and a second axially extending annular wall, said first and second wall being coannular and radially spaced apart to bound therebetween an axially extending annular fluid flow path, one of said first and second wall further defining a multitude of circumferentially arrayed and spaced apart radially extending cavities each having a like determined internal transverse cross sectional shape, said multitude of cavities opening to said fluid flow path in respective circumferentially spaced apart recesses and including a substantially continuous radially extending internal surface defining said internal cross sectional shape, a respective multitude of circumferentially arrayed and spaced apart guide vanes each having a portion thereof of said determined transverse cross sectional shape and slidably received individually in respective ones of said multitude of cavities for relative radial movement into and out of said fluid flow path, and mechanical actuator means for selectively moving said multitude of guide vanes into and out of said fluid flow path during operation of said engine, wherein said portion of each of said multitude of guide vanes defines a radially disposed surface extending axially, said radially disposed surface matching a contour of said one wall within the axial extension of said portion, wherein each said portion comprises a base member disposed adjacent said fluid flow path when the respective guide vane is fully inserted into the latter, and said radially disposed surface aligning with said one of said first and second wall and bounding said flow path upon full insertion of said respective guide vane into said fluid flow path.

* * * * *